US006604730B1

(12) United States Patent
Shafer

(10) Patent No.: US 6,604,730 B1
(45) Date of Patent: Aug. 12, 2003

(54) VEHICLE LIFTING PAD SYSTEM

(76) Inventor: Michael Shafer, 4808 US Alt 19 N., Palm Harbor, FL (US) 34683

( * ) Notice: Subject to any disclaimer, the term of this patent is extended or adjusted under 35 U.S.C. 154(b) by 0 days.

(21) Appl. No.: 10/062,241

(22) Filed: Feb. 1, 2002

(51) Int. Cl.[7] ..... B66F 3/00

(52) U.S. Cl. ..... 254/133 R

(58) Field of Search ..... 254/133 R, 134, 254/8 B, 100, DIG. 4

(56) References Cited

U.S. PATENT DOCUMENTS 5,448,809 A * 9/1995 Kraus ..... 24/297

* cited by examiner

*Primary Examiner*—Robert C. Watson
(74) *Attorney, Agent, or Firm*—Edward P. Dutkiewcz

(57) ABSTRACT

A vehicle lifting pad system comprises a pad. The pad has a large base plate, a small intermediate plate and a plurality of fingers. The base plate has sides. Two parallel close sides and two parallel distant sides. The intermediate plate has top and bottom faces. A first pair of parallel fingers is closely spaced and a second pair of parallel fingers is widely spaced. Each finger has an enlarged retention head facing exteriorly away from the other fingers. Each finger has a surface between its retention head and the intermediate plate for being received by an aperture of a vehicle with the retention head above the aperture.

6 Claims, 4 Drawing Sheets

FIG 1
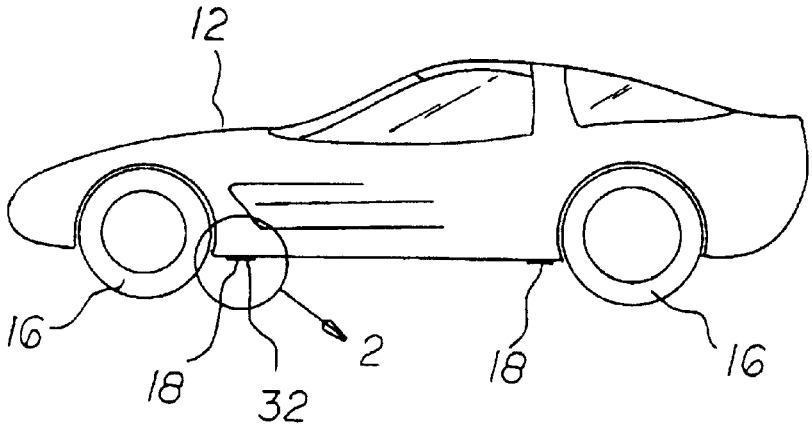
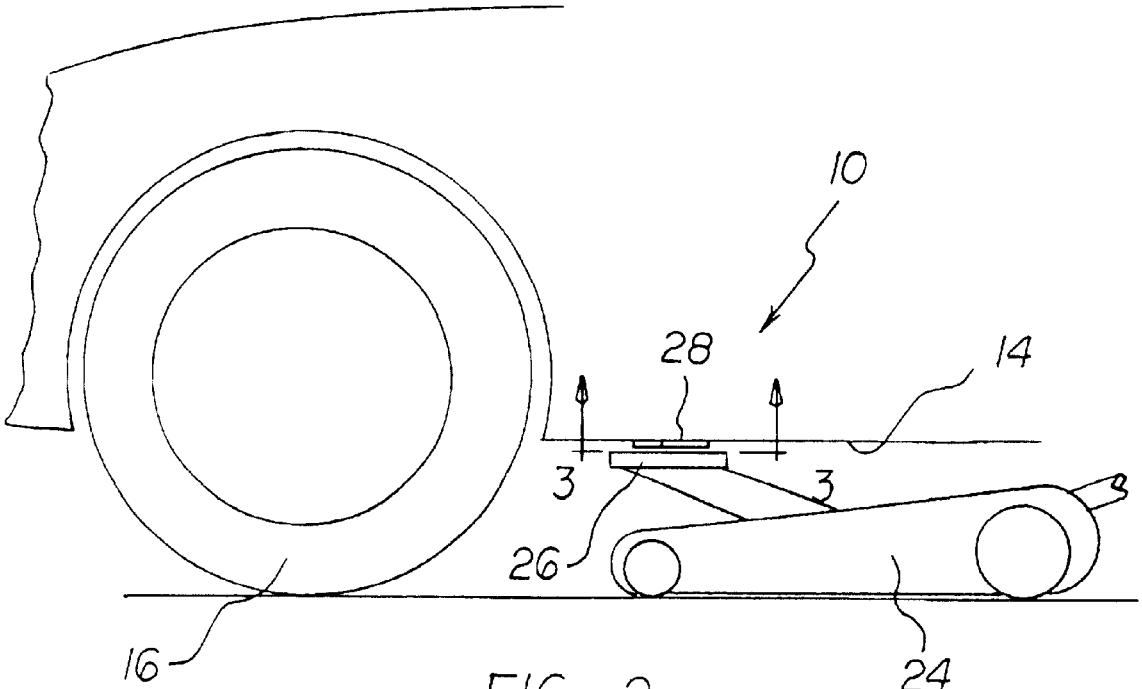
FIG 2

FIG 3
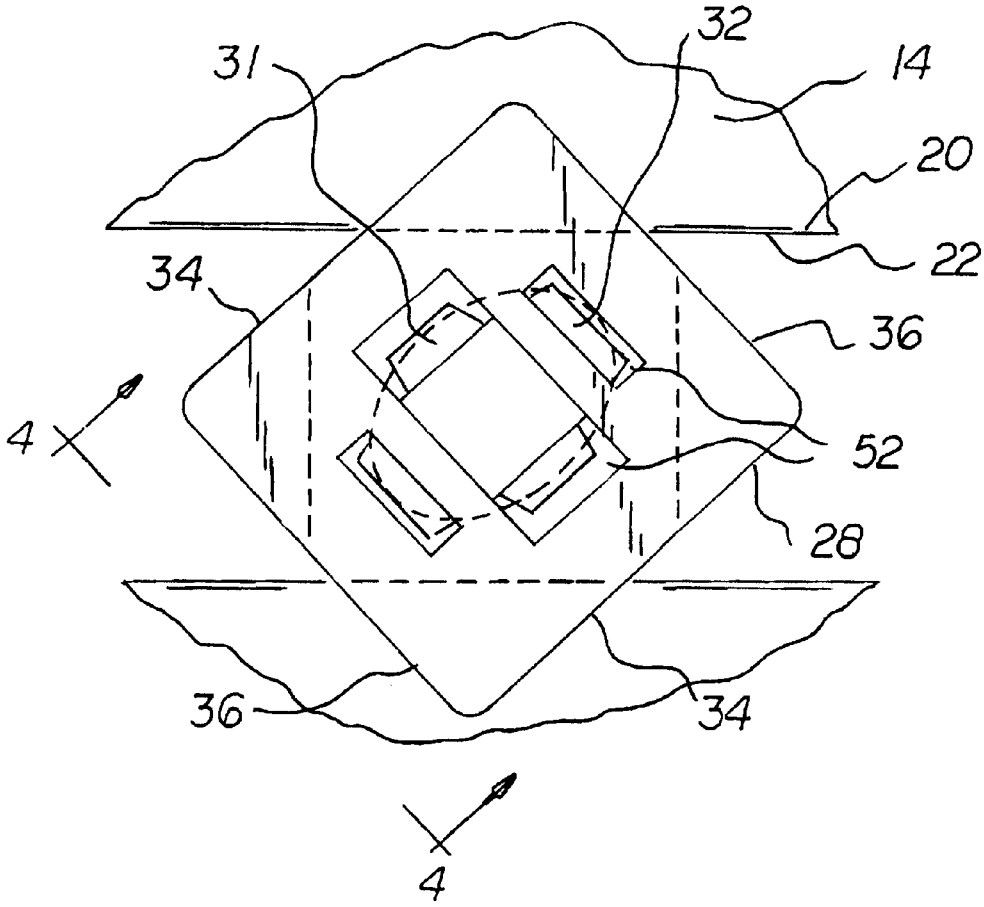
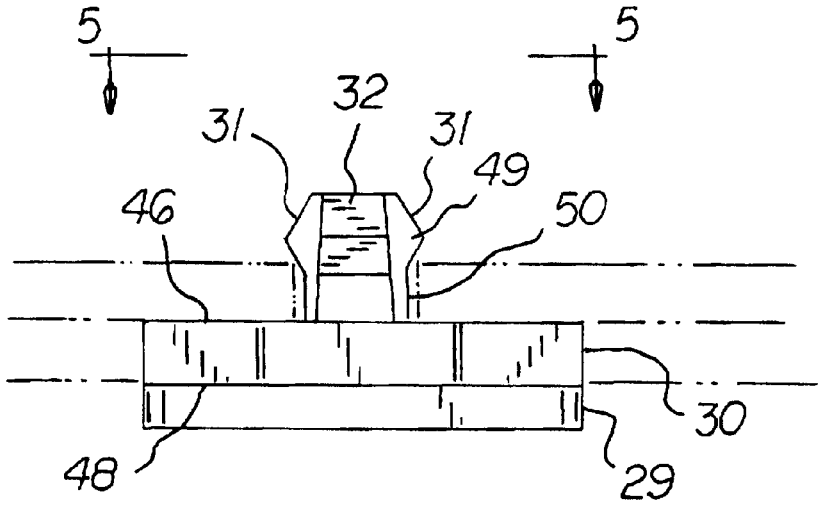
FIG 4

VEHICLE LIFTING PAD SYSTEM

BACKGROUND OF THE INVENTION

1. Field of the Invention

The present invention relates to a vehicle lifting pad system and more particularly pertains to preventing lifting devices of known designs and configurations.

2. Description of the Prior Art

The use of vehicle lifting devices of known designs and configurations is known in the prior art. More specifically, vehicle lifting devices of known designs and configurations previously devised and utilized for the purpose of abating damage to vehicles during maintenance through known methods and apparatuses are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned patents do not describe a vehicle lifting pad system that allows preventing lifting devices of known designs and configurations.

In this respect, the vehicle lifting pad system according to the present invention substantially departs from the conventional concepts and designs of the prior art, and in doing so provides an apparatus primarily developed for the purpose of preventing lifting devices of known designs and configurations.

Therefore, it can be appreciated that there exists a continuing need for a new and improved vehicle lifting pad system which can be used for preventing lifting devices of known designs and configurations. In this regard, the present invention substantially fulfills this need.

SUMMARY OF THE INVENTION

In view of the foregoing disadvantages inherent in the known types of vehicle lifting devices of known designs and configurations now present in the prior art, the present invention provides an improved vehicle lifting pad system. As such, the general purpose of the present invention, which will be described subsequently in greater detail, is to provide a new and improved vehicle lifting pad system and method which has all the advantages of the prior art and none of the disadvantages.

To attain this, the present invention essentially comprises a vehicle. The vehicle has a top surface and a bottom surface. The bottom surface has a plurality of wheels. The bottom surface has a plurality of lifting regions. The lifting regions are of structural rigidity. In this manner the lifting regions serve as areas where the vehicle can be lifted by a jack. Such regions include a thin support beam. The support beam has an oval aperture passing there through. A lifting apparatus is further provided. The lifting apparatus has a lifting arm. The lifting arm is adapted to fit beneath the vehicle and elevate the vehicle. Provided last is a pad. The pad is fabricated of a rigid plastic material in a generally rectilinear configuration. The pad has a rectangular base plate, an intermediate plate and four fingers. The base plate has four sides. The four sides include two parallel first sides and two parallel second sides there between and a thickness with a top face and a bottom face. The intermediate plate is of a generally hexagonal configuration with two parallel close sides and two parallel distant side. The intermediate plate has a top face and a bottom face. The bottom face is of the intermediate plate formed integral with the top face of the base plate. Each finger projects perpendicularly up from the top face of intermediate plate. A first pair of parallel fingers is closely spaced inwardly of the close sides. A second pair of parallel fingers is spaced inwardly of the distant sides. Each finger has an angular retention head. The retention head faces exteriorly away from the other fingers. Each finger has a surface between its retention head and the intermediate plate for being received by the aperture of the vehicle. The retention head is provided above the aperture. The pad also has an oval hole through the base plate and intermediate plate adjacent to each of the fingers beneath an associated retention head for allowing insertion of a tool into contact with a retention head to pivot a finger when removing a pad from the vehicle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved vehicle lifting pad system which has all of the advantages of the prior art vehicle lifting devices of known designs and configurations and none of the disadvantages.

It is another object of the present invention to provide a new and improved vehicle lifting pad system which may be easily and efficiently manufactured and marketed.

It is further an object of the present invention to provide a new and improved vehicle lifting pad system which is of durable and reliable constructions.

An even further object of the present invention is to provide a new and improved vehicle lifting pad system which is susceptible of a low cost of manufacture with regard to both materials and labor, and which accordingly is then susceptible of low prices of sale to the consuming public, thereby making such vehicle lifting pad system economically available to the buying public.

Even still another object of the present invention is to provide a vehicle lifting pad system for preventing lifting devices of known designs and configurations.

Lastly, it is an object of the present invention to provide a new and improved vehicle lifting pad system comprising a pad. The pad has a large base plate, a small intermediate plate and a plurality of fingers. The base plate has sides. Two parallel close sides and two parallel distant sides. The intermediate plate has top and bottom faces. A first pair of parallel fingers is closely spaced and a second pair of parallel fingers is widely spaced. Each finger has an enlarged retention head facing exteriorly away from the other fingers. Each finger has a surface between its retention head and the intermediate plate for being received by an aperture of a vehicle with the retention head above the aperture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of the vehicle adapted to receive a vehicle lifting pad system constructed in accordance with the principles of the present invention.

FIG. 2 is a view of the circled portion of FIG. 1 and illustrating a jack positioned there beneath.

FIG. 3 is a bottom view of the system taken along line 3—3 of FIG. 2.

FIG. 4 is a side view of the system taken along line 4—4 of FIG. 3.

The same reference numerals refer to the same parts throughout the various Figures.

DESCRIPTION OF THE PREFERRED EMBODIMENT

Figure 5:
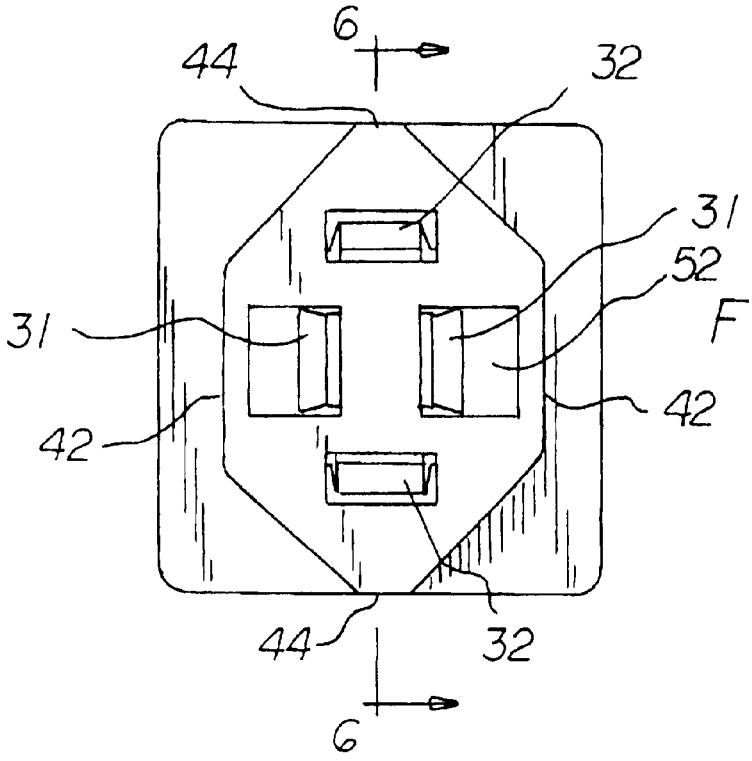
FIG. 5 is a plan view of the system taken along line 5—5 of FIG. 4.
Figure 6:
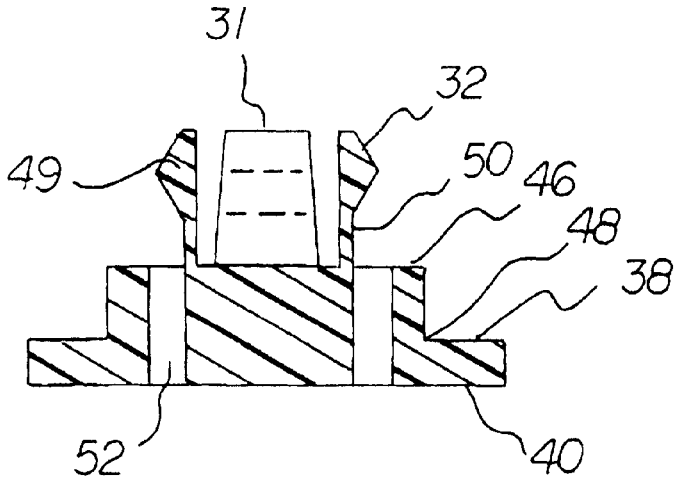
FIG. 6 is a sectional view of the system taken along line 6—6 of FIG. 5.
Figure 7:
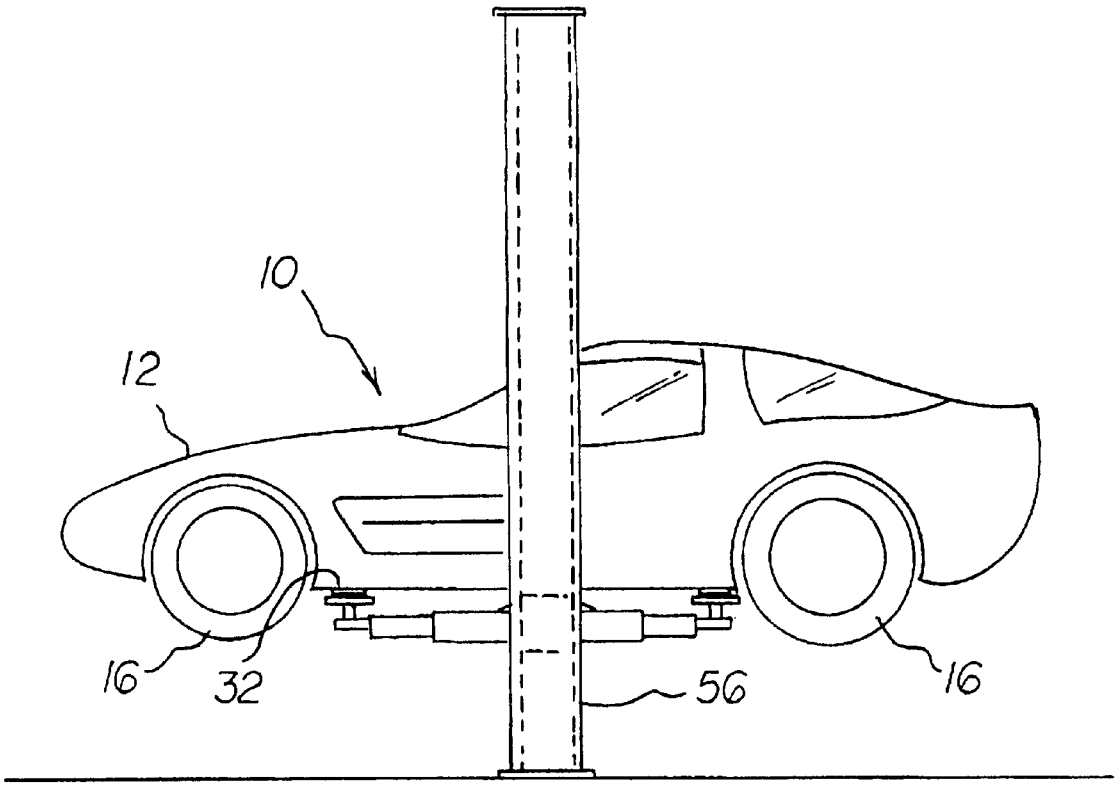
FIG. 7 is a side view of an alternate embodiment illustrating a jack formed as a hoist for lifting from a plurality of locations.

With reference now to the drawings, and in particular to FIG. 1 thereof, the preferred embodiment of the new and improved vehicle lifting pad system embodying the principles and concepts of the present invention and generally designated by the reference numeral 10 will be described.

The present invention, the vehicle lifting pad system 10 is comprised of a plurality of components. Such components in their broadest context includes a pad. Such components are individually configured and correlated with respect to each other so as to attain the desired objective.

First provided is a vehicle 12. The vehicle has a top surface 13 and a bottom surface 14. The bottom surface has a plurality of wheels 16. The bottom surface has a plurality of lifting regions 18. The lifting regions are of structural rigidity. In this manner the lifting regions serve as areas where the vehicle can be lifted by a jack. Such regions include a thin support beam 20. The support beam has an oval aperture 22 passing there through.

A lifting apparatus 24 is further provided. The lifting apparatus has a lifting arm 26. The lifting arm is adapted to fit beneath the vehicle and elevate the vehicle.

Provided last is a pad 28. The pad is fabricated of a rigid plastic material in a generally rectilinear configuration. The pad has a rectangular base plate 29, an intermediate plate 30 and four fingers 31, 32. The base plate has four sides. The four sides include two parallel first sides 34 and two parallel second sides 36 there between and a thickness with a top face 38 and a bottom face 40.

The intermediate plate is of a generally hexagonal configuration with two parallel close sides 42 and two parallel distant side 44. The intermediate plate has a top face 46 and a bottom face 48. The bottom face is of the intermediate plate formed integral with the top face of the base plate.

Each finger projects perpendicularly up from the top face of intermediate plate. A first pair of parallel fingers 53 is closely spaced inwardly of the close sides. A second pair of parallel fingers 54 is spaced inwardly of the distant sides. Each finger has an angular retention head 49. The retention head faces exteriorly away from the other fingers. Each finger has a surface 50 between its retention head and the intermediate plate for being received by the aperture of the vehicle. The retention head is provided above the aperture.

The pad also has an oval hole 52 through the base plate and intermediate plate adjacent to each of the fingers beneath an associated retention head for allowing insertion of a tool into contact with a retention head to pivot a finger when removing a pad from the vehicle.

This product was designed to provide a life point for a floor jack or service rack without damaging the underbody, floor pans or lower body panels. Even an inexperienced tire changer or service technician can lift your vehicle, for example a C-5 Corvette, without damaging it. This product can be installed temporarily or left installed permanently without changing the appearance of the vehicle. This adapter or plate securely snaps into place on all four corners of a vehicle. On a C-5 Corvette the holes are built into the frame.

Made of high density polypropylene this product should prove years of damage free lifting without the need for replacement, giving piece of mind to even the most conscientious Corvette owner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A vehicle lifting pad system for preventing damage to the under side of a vehicle during, lifting by a jack comprising, in combination:

a vehicle having a top surface and a bottom surface, the bottom surface having a plurality of wheels and a plurality of lifting regions of structural rigidity which serve as areas where the vehicle can be lifted as by a jack, such regions include a thin support beam with an oval aperture passing there through;

a lifting apparatus with a lifting arm adapted to fit beneath the vehicle and elevate the vehicle;

a pad fabricated of a rigid plastic material in a generally rectilinear configuration and having a rectangular base plate, an intermediate plate and four fingers, the base plate having four sides including two parallel first sides and two parallel second sides there between and a thickness with a top face and a bottom face, the intermediate plate being of a generally hexagonal configuration with two parallel close sides and two parallel distant side and having a top face and a bottom face with the bottom face of the intermediate plate formed integral with the top face of the base plate, and with each finger project perpendicularly up from the top face of intermediate plate and with a first pair of parallel fingers closely spaced inwardly of the close sides and a second pair of parallel fingers spaced inwardly of the distant sides, each finger having an angular retention head facing exteriorly away from the other fingers, each finger having a surface between its retention head and the intermediate plate for being received by the aperture of the vehicle with the retention head above the aperture, the pad also have an oval hole through the base plate and intermediate plate adjacent to each of the fingers beneath an associated retention head for allowing insertion of a tool into contact with a retention head to pivot a finger when removing a pad from the vehicle.

2. A vehicle lifting pad system comprising:

a pad having a large base plate, a small intermediate plate and a plurality of fingers, the base plate having sides with a top face and a bottom face, the intermediate plate having sides with a top face and a bottom face with the bottom face of the intermediate plate formed integral with the top face of the base plate, and with each finger coupled to and projecting perpendicularly upwardly from the top face of intermediate plate and with a first pair of parallel fingers closely spaced and a second pair of parallel fingers widely spaced, each finger having an enlarged retention head facing exteriorly away from the other fingers, each finger having a surface between its retention head and the intermediate plate for being received by an aperture of a vehicle with the retention head above the aperture.

3. The system as set forth in claim 2 and further including:

a vehicle having a top surface and a bottom surface, the bottom surface have a plurality of wheels and a plurality of lifting regions of structural rigidity which serve as areas where the vehicle can be lifted as by a jack, such regions include a thin support beam with an oval aperture passing there through.

4. The system as set forth in claim 3 and further including:

a lifting apparatus with a lifting arm adapted to fit beneath the vehicle and elevate the vehicle.

5. The system as set forth in claim 4 wherein the lifting apparatus is a jack positionable adjacent one pad.

6. The system as set forth in claim 4 wherein the lifting apparatus is a hoist positionable adjacent a plurality of pads on a vehicle.

* * * * *